US006227917B1

(12) United States Patent
Chou

(10) Patent No.: US 6,227,917 B1
(45) Date of Patent: May 8, 2001

(54) CONTACT STRUCTURE FOR HIGH SPEED TRANSMISSION CONNECTOR

(75) Inventor: Chih-Hsien Chou, San Jose, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/379,379

(22) Filed: Aug. 23, 1999

(51) Int. Cl.[7] ..... H01R 4/48
(52) U.S. Cl. ..... 439/862
(58) Field of Search ..... 439/862, 637, 439/636

(56) References Cited

U.S. PATENT DOCUMENTS 3,348,191 * 10/1967 Kinkaid ..... 439/637
3,530,422 * 9/1970 Goodman ..... 439/637

* cited by examiner

*Primary Examiner*—Gary F. Paumen

(74) *Attorney, Agent, or Firm*—Wei Te Chung

(57) ABSTRACT

A contact (16) of an electrical connector (10) includes a base (18) fixed in a corresponding slot (14) defined in a housing (12) of the connector and a spring beam (22) extending from the base for resiliently engaging with a circuit board inserted into the connector. The contact is made from a thin metal sheet by blanking. The spring beam of the contact has a cross-sectional area determined by first and second dimensions thereof. The second dimension corresponds to the thickness (T) of the metal sheet and the first dimension (W) is parallel to the surface of the metal sheet and thus is allowed to increase as desired in the blanking process. The increase of the first dimension increases the cross-sectional area thereby reducing the inductance of the spring beam. The spring contact is then twisted to switch the first and second dimensions thereof whereby bending rigidity of the beam is substantially reduced leading to a reduction of the normal force acting upon the spring beam when the circuit board is inserted into the connector. Thus, the mating force for connecting the circuit board is reduced, while the inductance is kept low. Electrical and mechanical requirements for a high transmission speed connector are thus met simultaneously.

1 Claim, 4 Drawing Sheets

CONTACT STRUCTURE FOR HIGH SPEED TRANSMISSION CONNECTOR

BACKGROUND OF THE INVENTION

1. Field of the Invention

The present invention generally relates to a contact of an electrical connector, and in particular to a contact structure that meets the requirements of high-speed signal transmission.

2. The Prior Art

Electrical connectors provide electrical connections between electrical devices. Signals transmitted between the electrical devices are sent through the electrical connectors. The operational speed of electrical devices is substantially increased recently and it requires high speed transmission of signals therebetween in order to maintain the performance thereof. Thus, the electrical connectors have to be capable to transmit signals in high speed/frequency. For high-speed applications, contacts of an electrical connector must have low inductance. A general way to achieve the low inductance requirement for a contact is to increase the cross-sectional area of the contact through which electrical current flows and/or to reduce length of the contact for shortening the current path. Increasing the cross-sectional area or shortening the length of a contact, however, increases the magnitude of the normal force acting upon a mating contact engaging therewith thereby increasing the insertion force between mating connectors.

It is thus desired to provide a contact of an electrical connector which eliminates the dilemma discussed above.

SUMMARY OF THE INVENTION

Accordingly, an object of the present invention is to provide a contact of an electrical connector which reduces the inductance thereof while maintaining a low mating force.

Another object of the present invention is to provide a contact of an electrical connector which allows easy adjustment of the inductance thereof while maintaining a low mating force.

A further object of the present invention is to provide a method for making a contact of an electrical connector of which the inductance is readily adjusted while the mating force is maintained low.

To achieve the above objects, a contact of an electrical connector in accordance with the present invention comprises a base fixed in a corresponding slot defined in a housing of the connector and a spring beam extending from the base for resiliently engaging with a circuit board inserted into the connector. The contact is made from a thin metal sheet by blanking. The spring beam of the contact has a cross-sectional area determined by first and second dimensions thereof. The second dimension corresponds to the thickness of the metal sheet and the first dimension is parallel to the surface of the metal sheet and thus is allowed to increase as desired in the blanking process. The increase of the first dimension increases the cross-sectional area thereby reducing the inductance of the spring beam. The spring contact is then twisted to switch the first and second dimensions thereof whereby bending rigidity of the spring beam is substantially reduced leading to a reduction of the normal force acting upon the spring beam when the circuit board is inserted into the connector. Thus, the mating force for connecting the circuit board to the connector is reduced, while the inductance is kept low. Electrical and mechanical requirements for a high transmission speed connector are thus met simultaneously.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
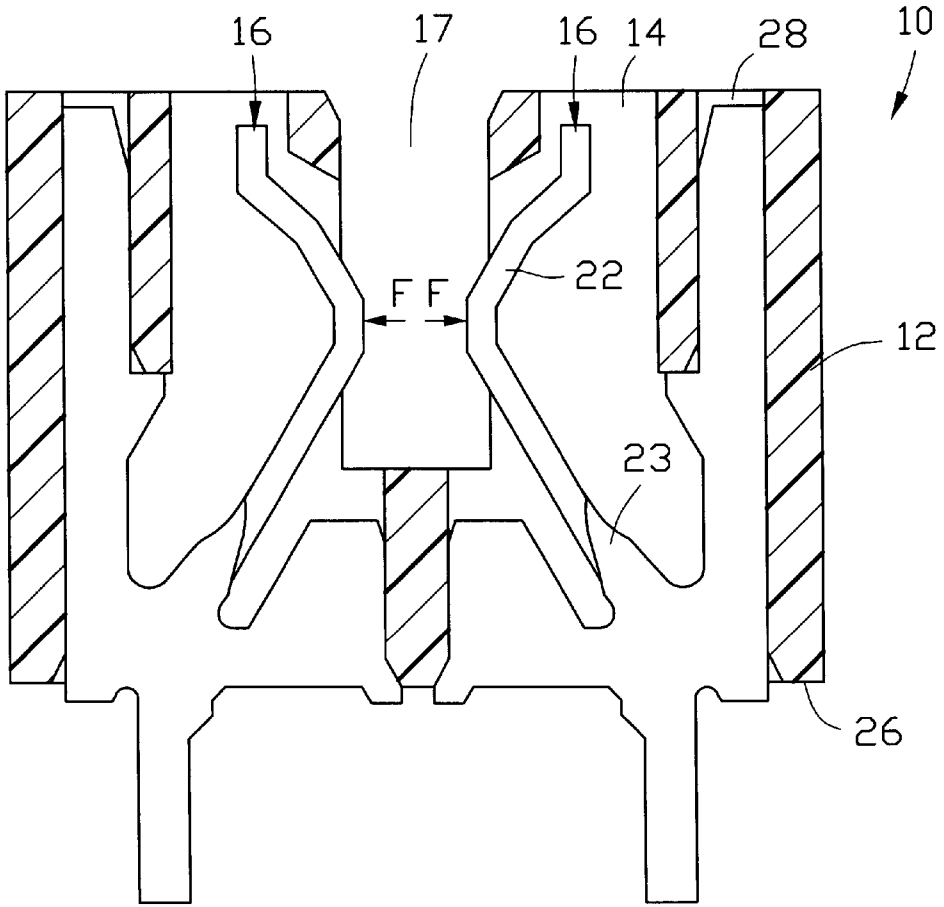
FIG. 1 is a cross-sectional view of an electrical connector comprising contacts constructed in accordance with the present invention.

Referring to the drawings and in particular to FIG. 1, an electrical connector 10 comprises an insulative housing 12 defining a plurality of contact receiving slots 14 for receiving contacts 16 constructed in accordance with the present invention therein. A central slot 17 is defined in the housing 12 for receiving an electronic device, such as memory module (not shown).

Figure 3:
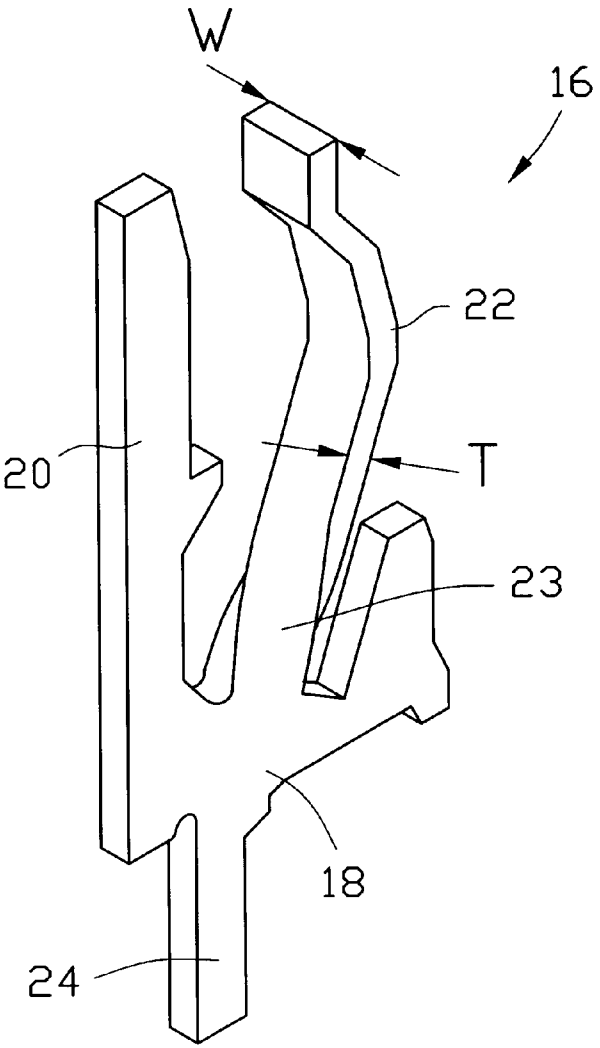
FIG. 3 is similar to FIG. 2 but showing the contact after the spring beam is twisted.

Also referring to FIG. 3, each contact 16 comprises a base 18, a retention beam 20 and a spring beam 22 extending from a first side of the base 18 and spaced from each other, and a tail section 24 extending from an opposite second side of the base 18. The contact 16 is received in the contact receiving slot 14 of the housing 12 with the tail section 24 thereof extending beyond a bottom face 26 of the housing 12 for being soldered to a circuit board (not shown). The retention beam 20 is interferentially received and thus retained in a channel 28 defined in the housing 12 in communication with the slot 14. The spring beam 22 is arcuate for partially extending into the central slot 17 to electrically engage with the memory module.

During the insertion of the memory module into the central slot 17, a normal force F is exerted to the spring beam 22 of each contact 16 for forcibly separating the spring beams 22 to accommodate the memory module. The normal force F contributes to an insertion force required to insert the memory module into the connector 10. To allow easy insertion of the memory module into the connector 10, the insertion force must be minimized which implies that the normal forces F must be reduced. A major factor contributing to the magnitude of the normal force F acting upon the spring beam 22 is the bending rigidity of the spring beam 22. The bending rigidity of a beam is controlled by the dimensions of the cross section thereof. Namely, the bending rigidity is in generally linearly proportional to the width W of the spring beam 22 and is a cubic function of the thickness T thereof. The term "thickness" used herein refers to the dimension of the cross section of the spring 22 beam substantially in the direction of the normal force F, while the term "width" is the dimension of the cross section in a direction normal to the normal force F, that is the direction normal to the plane of FIG. 1. Thus, to reduce the normal force F, the width W and the thickness T must be reduced.

On the other hand, to maintain desired electrical performance, inductance of the spring beam 22 which constitutes a current path between the memory module and the circuit board to which the tail section 24 is soldered has to be properly controlled. In general, for high speed signal transmission through the contact 16, the inductance thereof has to be reduced. To reduce the inductance of the spring beam 22, the cross-sectional area thereof determined by the multiplication of the width W and thickness T must be increased. This implies an increase of the width W and the thickness T. This is in conflict with the requirements to minimize normal force.

Such a conflict may be addressed by noting that the bending rigidity of a beam is a cubic function of the thickness thereof and is a linear function of the width thereof. The thickness is the dominant factor in determining the bending rigidity. Thus, by increasing the width W while maintaining or reducing the thickness T, the cross-sectional area of the spring beam 22 may be increased without unduly increasing the bending rigidity.

Using a thick metal plate to form a contact by blanking technique, however, is subject to a limit of the thickness of the metal plate that may be worked on using the technique. This imposes a limit in increasing the width of the spring beam. Furthermore, contacts made from a thick metal plate by blanking are not suitable for fine pitch arrangement of the contacts in a connector.

Figure 2:
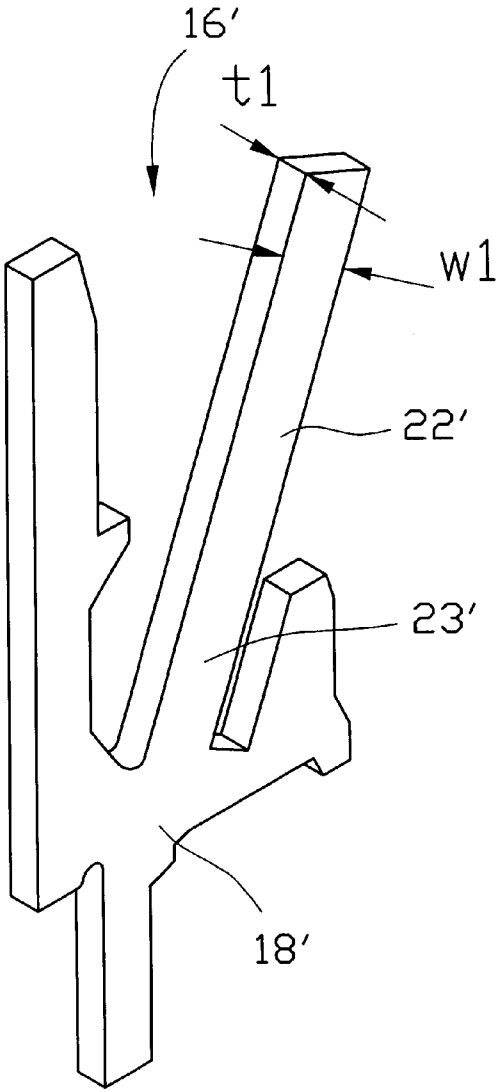
FIG. 2 is a perspective view of a contact of the present invention before a spring beam thereof is twisted

To solve the problem, referring to FIG. 2, a contact 16' is formed from a thin metal plate such that a spring beam 22' thereof has a cross-sectional area meeting the requirement of inductance. The cross-sectional area is determined by a first dimension t1 and a second dimension w1. The first dimension t1 is the thickness of the thin metal plate from which the contact 16' is made, while the second dimension w1 is the dimension in the direction normal to the direction of the first dimension t1. In other words, the first dimension t1 is fixed and cannot be increased but the second dimension w1 is in a direction parallel to the surface of the thin metal plate and may thus be increased as desired. The second dimension w1 may be increased to such an extent that the cross-sectional area meets the requirement of inductance. The spring beam 22' is then twisted at a portion 23' proximate a base 18' of the contact 16'. In other words, a first section of the spring beam 22' is directly fixed to the base 18' while a second section thereof is twisted with respect to the first section. The spring beam 22 is twisted substantially 90 degrees at a twisted portion 23 for changing the second dimension w1 of the original spring beam 22' that is allowed to increase to the width direction of the deformed spring beam 22 and the first dimension t1 to the thickness direction as shown in FIG. 3. In this way, the cross-sectional area of a spring beam of a contact may be readily increased while the bending rigidity thereof is maintained at a desired level. The normal force F is controlled within a desired range without substantially hindering ready insertion of the memory module, while the cross-sectional area is increased to such an extent to reduce the inductance.

Figure 4:
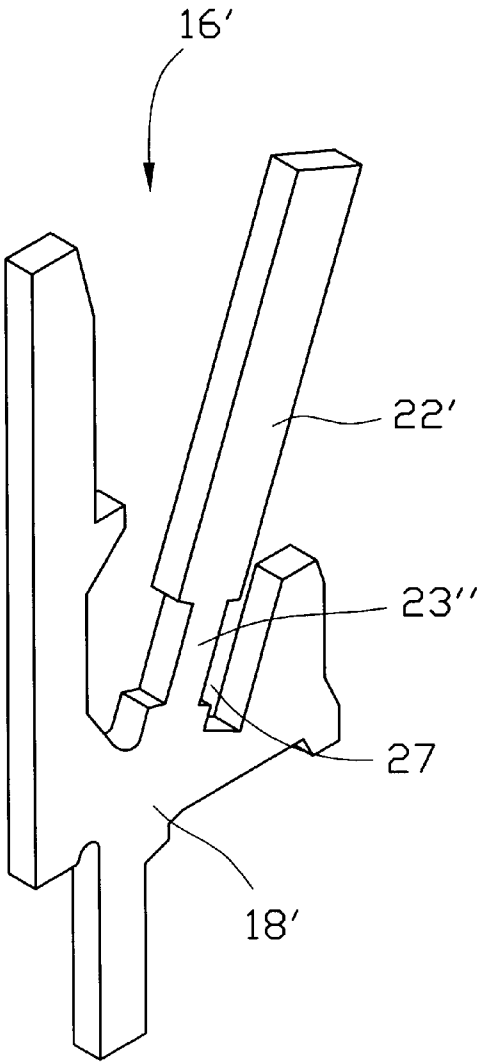
FIG. 4 is similar to FIG. 2 but showing a second embodiment of the present invention.

To facilitate the twisting operation, the portion 23' of the original spring beam 22' before twisting may be shaped to have a reduced dimension as shown in FIG. 4 and indicated at 23". This may be done by forming cutouts 27 on opposite sides of the beam 22'.

If desired, the spring beam 22' may be pressed to a thinner thickness than the thickness of the metal plate from which the contact 16' is made. This may reduce the normal force while substantially maintaining the inductance for the deformed contact 16 because the thickness is reduced but the cross-sectional area is kept substantially the same.

One feature of the invention is to provide a high speed card edge connector with therein twisted contacts wherein each pair of opposite contacts located in the same cross-sectional plane, have their own respective retention means for respectively holding themselves in the individual corresponding contact receiving (second) slots, have their own respective engaging portions extending into the central (first) slot for engagement with the different circuit pads on the card inserted into the central slot, and have their own respective twisted portions of which one rotates clockwise while the other rotates counterclockwise for applying counterbalanced possible forces on two sides of the inserted card which may be generated from the twisting procedure. Therefore, the inserted card will not be affected to be tilted by any improper forces due to the twisting contacts.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A contact of an electrical connector, the contact comprising a base adapted to be fixed in a receiving slot defined in the connector, a spring beam and a retention beam which are spaced apart from each other a distance and extend from one side of the base, the spring beam comprising a first section connected to the base by a second section with the second section being twisted with respect to the base, said retention beam being adapted for retaining the contact in the connector, wherein the first section of the spring arm has a cross section defined by first and second dimensions which are in first and second reference directions prior to a twisting operation of the second section relative to the base, the second section being twisted relative to the base such that the first and second dimensions are changed to be in the second and first reference directions respectively;

wherein the second section of the spring beam is twisted ninety degrees with respect to the base;

wherein the first reference direction defines a direction along which a normal force acts upon the spring beam when the contact engages and electrically connects to an external device and wherein the second dimension is substantially smaller than the first dimension for reducing bending rigidity of the spring beam against the normal force;

wherein the second section has a dimension smaller than the first section for facilitating twisting;

wherein the second section forms cutouts on opposite sides thereof whereby the dimension of the second section is smaller than that of the first section.

* * * * *